United States Patent [19]

Moriyama

[11] 4,177,046

[45] Dec. 4, 1979

[54] AC TYPE DUST COLLECTING APPARATUS

[76] Inventor: Toshio Moriyama, 14-10, Eifuku 1-chome, Suginami-ku, Tokyo-to, Japan

[21] Appl. No.: 937,986

[22] Filed: Aug. 30, 1978

[51] Int. Cl.[2] ..... B03C 3/04; B03C 3/47

[52] U.S. Cl. ..... 55/123; 55/130; 55/137; 55/146; 55/157

[58] Field of Search ..... 55/123, 130, 131, 128, 55/137, 146, 154–157

[56] References Cited

U.S. PATENT DOCUMENTS

| | | | |
|---|---|---|---|
| 1,853,393 | 4/1932 | Anderson | 55/123 X |
| 1,943,070 | 1/1934 | Grave | 55/154 X |
| 2,382,254 | 8/1945 | Penney et al. | 55/137 |
| 2,395,927 | 3/1946 | White | 55/137 X |

FOREIGN PATENT DOCUMENTS

| | | | |
|---|---|---|---|
| 947158 | 6/1949 | France | 55/154 |
| 953703 | 12/1949 | France | 55/123 |
| 288208 | 3/1929 | United Kingdom | 55/157 |
| 716868 | 10/1954 | United Kingdom | 55/155 |

*Primary Examiner*—Kathleen J. Prunner
*Attorney, Agent, or Firm*—Kenyon & Kenyon

[57] ABSTRACT

Grid elements are provided between a dust collecting plate and discharge electrodes in a dust collecting apparatus. The grid elements are arranged in the form of a drainboard in parallel with the dust collecting plate. AC voltage is applied to the discharge electrodes so that the voltage induced in the grid elements is utilized for collecting dust.

1 Claim, 5 Drawing Figures

AC TYPE DUST COLLECTING APPARATUS

BACKGROUND OF THE INVENTION

This invention relates to electrical dust collecting apparatuses and more particularly to an improvement of such a dust collecting apparatus.

In electrical dust collecting, a high DC voltage is applied to a discharge electrode to cause corona discharge thereby to charge dust in a gas, the dust thus charged is separated from the gas by an electromotive force in an electric field, and the dust thus separated is collected by a dust collecting electrode.

In this type of electrical dust collecting, the dust collecting performance is most greatly affected by the electrical resistance of dust. If dust has an electrical resistance higher than $10^{11}$ Ω-cm, it is difficult for a conventional DC type dust collecting apparatus to collect the dust unless humidity control is carried out by spraying water or steam into the gas.

For instance, dust in a dry cement waste gas (essentially containing CaO, dust such as lead oxide, zinc oxide, ferrosilicone and ferrochrome), in various electric furnace waste gases, dust in a waste mud incinerator waste gas, and dust in a sintering furnace waste gas have an extremely high electrical resistance of the order of $10^{11}$ to $10^{14}$ Ω-cm in a certain temperature range (100 -200° C. for instance) and in a certain humidity range (lower than 15% for instance).

The operation of the conventional DC type dust collecting apparatus to collect dust having such a high electrical resistance will be described. If negatively-charged dust is accumulated on its dust collecting electrode, the surface of the dust thus accumulated has a high negative potential. Therefore, negatively-charged dust on the discharge electrode is electrostatically repelled by the negative potential of the surface of the negatively-charged dust layer on the dust collecting electrode, thereby lowering its dust collecting performance. At the same time, a space charge effect takes place for the same reason, thus further lowering the dust collecting performance.

If the negative potential of the surface of the dust layer is increased to an extent that it ionizes the gas molecules in the dust layer, a so-called "back corona phenomenon" takes place and positive gas ions are therefore created on the surface of the dust layer. As a result, the charge of the negatively-charged dust on the discharge electrode is neutralized, and the dust collecting performance is increasingly lowered.

As is apparent from the above description, in collecting dust high in electrical resistance (higher than $10^{11}$ Ω-cm for instance) according to the DC charging system, as the surface potential of a dust layer is increased, dust charged with the same polarity is repelled thereby, thus lowering the dust collecting performance.

In order to overcome this difficulty, an AC charging system has been employed. However, in this case, dust is merely agglomerated by dust mutual collision due to the alternation in polarity of the line frequency, and therefore the dust collecting effect is not more than 60%. Thus, a high dust collecting effect cannot be expected.

In order to improve the dust collecting effect, a method has been thought of in which grid elements insulated from a dust collecting plate are provided in the space between the dust collecting plate and the discharge electrodes, and a voltage induced in the grid elements by AC polarity alternation is utilized for collecting dust. The grid elements are arranged in the form of a wire net. In either case, it has been ensured that even dust high in electrical resistance (higher than $10^{11}$ Ω-cm) can be sufficiently collected. However, this method is still disadvantageous in that as dust is deposited on the grid elements, the voltage induced in the grid elements is increased, and finally spark discharge occurs, as a result of which the dust collecting performance is extremely lowered.

SUMMARY OF THE INVENTION

Accordingly, an object of this invention is to eliminate all of the above-described drawbacks accompanying a conventional electrical dust collecting apparatus.

More specifically, an object of the invention is to provide an AC type dust collecting apparatus in which the dust collecting effect for dust having a high electrical resistance is improved.

The foregoing object and other objects as well as the characteristic features of the present invention will become more apparent from the following detailed description and the appended claim when read in conjunction with the accompanying drawings, in which like parts are designated by like reference numerals.

DETAILED DESCRIPTION OF THE INVENTION

Figure 2:
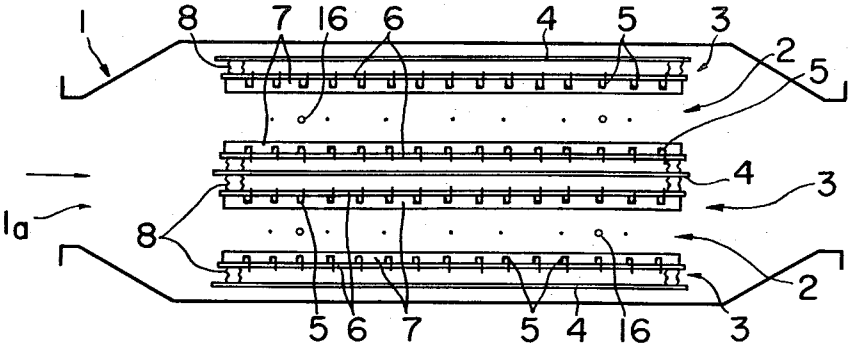
FIG. 2 is a sectional view taken along line X-X in FIG. 1.
Figure 4:
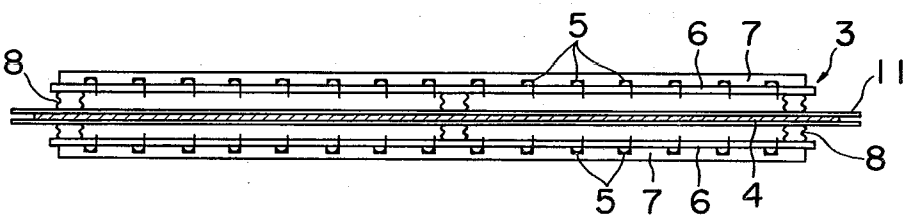
FIG. 4 is a sectional view taken along line Y-Y in FIG. 3.
Figure 1:
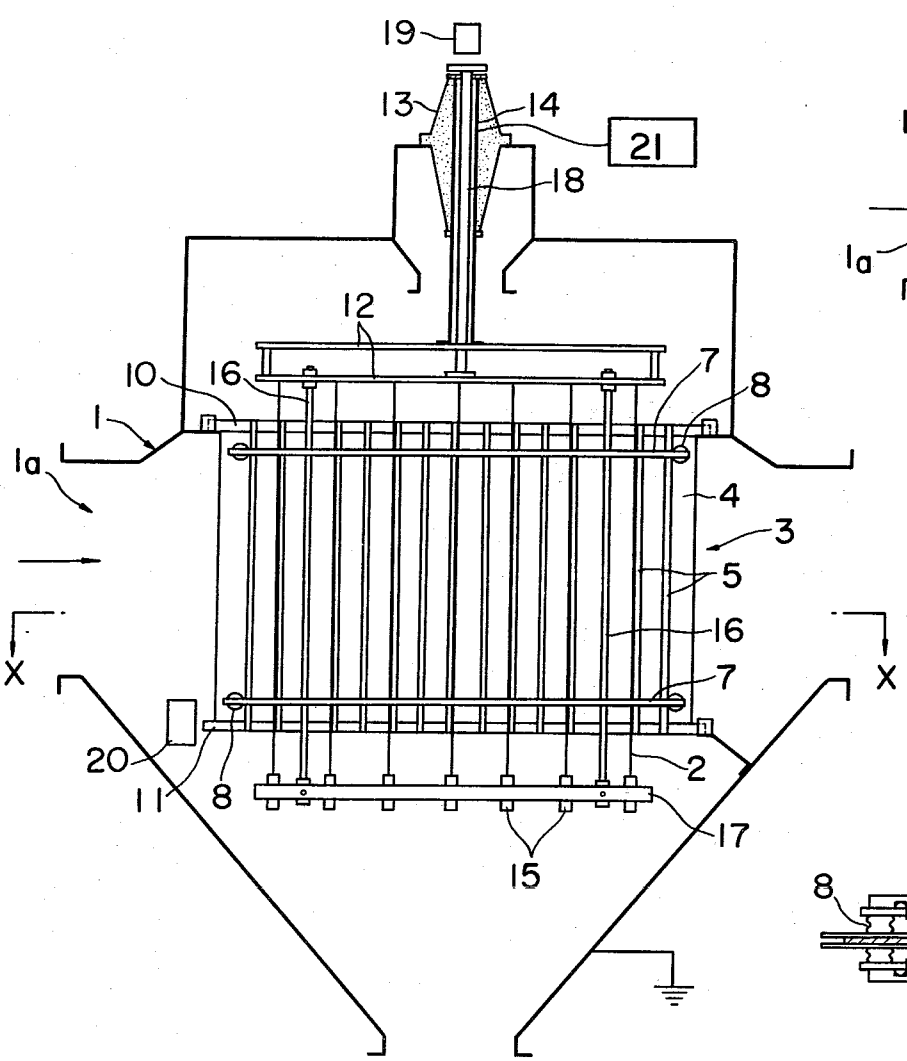
FIG. 1 is a vertical sectional view showing one preferred example of an AC type dust collecting apparatus according to the invention.
Figure 3:
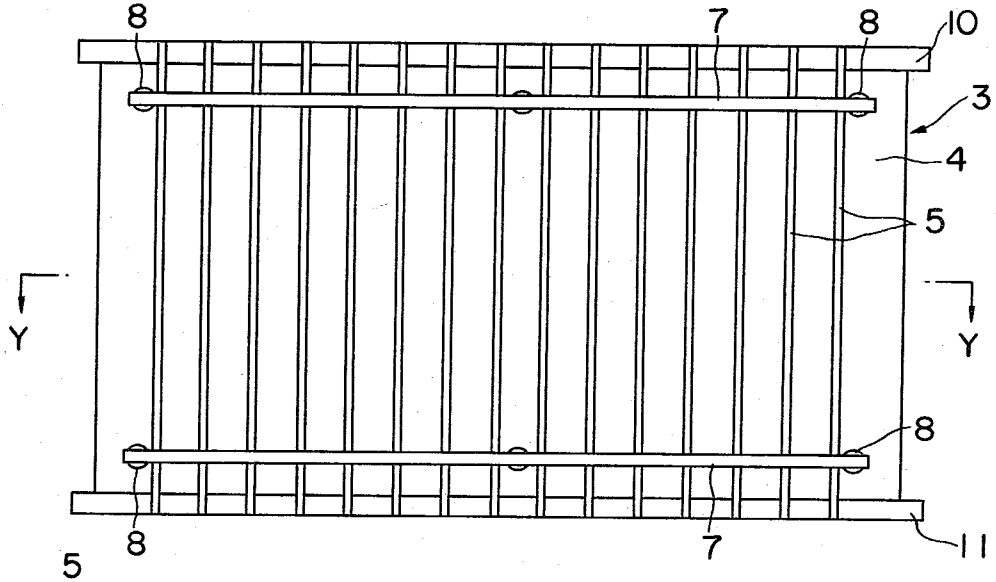
FIG. 3 is a front view showing a dust collecting electrode assembly employed in the apparatus in FIG. 1.
Figure 5:
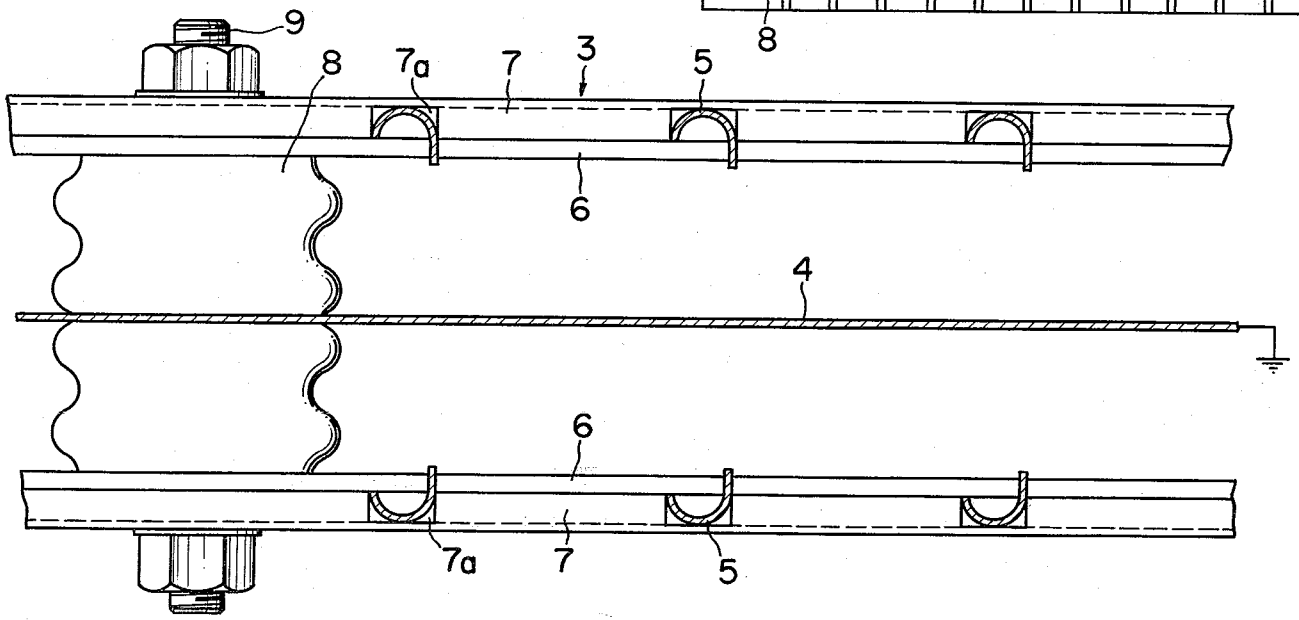
FIG. 5 is an enlarged view showing a part of the dust collecting electrode assembly.

One preferred example of an AC type dust collecting apparatus according to this invention, as shown in FIG. 1, comprises: an electrical dust collector housing 1; discharge electrodes 2; and dust collecting electrode assemblies 3.

The electrodes 2 and 3 are vertically juxtaposed in the housing 1. An AC power source 21 is connected to the discharge electrodes 2 to apply alternating current to each discharge electrode 2. Each of the dust collecting electrode assemblies 3 comprises voltage adjusting grid elements 5 which are insulated from a dust collecting plate 4. The voltage adjusting grid elements 5, each having a J-shaped section, are disposed in spaced, parallel relationship with one another and with the dust collecting plate 4. The upper end portions of the grid elements 5 are held by one pair of a grid supporting rod 6 and a grid retaining rod 7. Similarly, the lower end portions of the grid elements 5 are held by another pair of a grid supporting rod 6 and a grid retaining rod 7. Furthermore, the grid elements 5 are fixedly secured through the rods 6 and 7 which are secured by means of bolt and nut assemblies 9 and insulators 8 to the dust collecting plate 4, with the edges of the J-shaped grid elements 5 being faced towards the dust collecting plate 4.

The grid retaining rods 7 have grid supporting slots *7a* in which the grid elements are inserted and supported. The dust collecting plates 4 are supported by supporting rods 10 and 11 which are provided at the upper and lower edges of the dust collecting plates 4. That is, each dust collecting electrode assembly 3 including the dust collecting plate 4 is supported through the supporting rods 10 and 11 on the housing 1.

The dust collecting apparatus further comprises: a supporting frame 12 provided for the discharge electrodes 2 and supported through a discharge electrode supporting pipe 14 which is insulated by an insulator 13 from the housing so that the discharge electrodes 2 are suspended from the supporting frame 12; weights 15 connected to the lower end portions of the electrodes 2; swing-stopping frames 17 connected to the lower end portions of rods 16 connected to the supporting frame 12, the frames 17 serving to prevent the weights from being swung and to hold the weights at predetermined intervals; an impact rod 18 which, penetrating the discharge electrode supporting pipe 14, is connected to the supporting frame 12 and has its upper end portion protruded outside of the housing; a discharge electrode hammer 19, which is to hammer the discharge electrodes to prevent the deposition of dust thereon; and a dust collecting electrode hammer 20 which is struck against the lower supporting rod 11 of the dust collecting plate 4 to remove dust therefrom.

In operation, a high AC voltage is applied to the discharge electrodes 2 when a waste gas containing dust in electrical resistance is supplied through the inlet 1*a* of the housing. In this case, since the high AC voltage is applied to the discharge electrodes 2, the polarity of the discharge electrodes is repeatedly varied in accordance with the frequency of the power supply, and accordingly the polarity of a voltage induced in the grid elements 5, being the same as that of the discharge electrodes, is also repeatedly varied. In this case, the voltage induced in the grid elements shows an AC voltage waveform having a phase difference of approximately 90 degrees as the polarity of the AC voltage of the discharge electrodes is varied.

For instance, when the discharge electrodes are charged positive, a positive voltage is induced in the grid elements. This positive voltage is maintained unchanged for a period of time corresponding to approximately 90 degrees in phase difference even after the discharge electrodes are subsequently charged negative, because the grid elements are insulated. Therefore, as negatively charged dust approaches the grid elements, a part of the dust is attracted by the grid elements to be deposited thereon; however, almost all of the dust is accelerated by the positive potential of the grid element towards the dust collecting plate. Thus, dust can be effectively collected by the dust collecting plate.

The positive voltage of the grid elements, being neutralized by the negatively charged dust, is allowed to drop to a negative voltage while holding the phase difference of approximately 90 degrees. Accordingly, when the discharge electrodes are charged from negative to positive thereby to provide positively-charged dust, then the dust is attracted by the grid elements at a negative voltage. As a result, a part of the dust is deposited on the grid element, while almost all of the dust is moved towards the dust collecting plate. Thus, in this case also, the dust is effectively collected by the dust collecting plate.

As is apparent from the above description, since the positive and negative voltages are continuously and alternately induced in the grid elements, irrespective of the polarity of charged dust, that is, in the case where it is charged positive and in the case also where it is charged negative, the dust is attracted through the grid elements by the dust collecting plate. Thus, dust collecting is continuously carried out.

Furthermore, because of the particular, J-shaped, configuration of the grid elements, corona discharge takes place suitably at the opening edges, faced towards the dust collecting plate, of the grid elements, so that the induced voltage therein is not raised to an excessively high value. Therefore, charged dust passing through the spaces between the grid elements will never be repelled and blocked by the grid elements.

Even when the dust collecting plate is hammered to remove the dust deposited thereon, the induced voltage of the grid elements acts to prevent the dust from flying away again, that is, the dust is moved downwards in the form of a lump while abutting against the dust collecting plate, and is finally collected.

In the example described above, three dust collecting electrode assemblies are provided; however, it should be noted that the invention is not limited thereto or thereby; that is, the number of the dust collecting electrode assemblies may be more than three or less than three.

All of the electrical dust collecting apparatuses actually employed in various industrial fields are of the DC charging system as far as the inventor knows. With these dust collecting apparatuses of the DC charging system, humidity control is required to stably collect dust which is high in electrical resistance. However, in the AC type dust collecting apparatus, such humidity control is unnecessary, and accordingly it is not required to provide a device for treating waste water discharged out of the humidity control device. In addition, in the dust collecting apparatus of the DC charging system, a rectifier device is necessary for its high voltage generating unit. However, in the dust collecting apparatus according to the invention, such a rectifier device is not required, and merely a high voltage generating device of commercial frequency is employed.

Thus, according to this invention, manufacturing cost of the dust collecting apparatus of the invention is much lower than that of the conventional DC type dust collecting apparatus, and the maintenance of the former can be readily achieved when compared with that of the latter.

What is claimed is:

1. An AC type dust collecting apparatus comprising: a plurality of discharge electrodes; and a dust collecting electrode assembly, said dust collecting electrode assembly having a grounded dust collecting plate and a plurality of grid elements which are electrically insulated from said dust collecting plate, said grid elements being J-shaped in section and being arranged in spaced, parallel relationship with one another and with said dust collecting plate, with the curved portion of each J-shaped grid element faced towards said plurality of discharge electrodes and with the open edges of each grid element faced towards said dust collecting plate, an AC power source connected to said discharge electrodes to apply alternating current to said discharge electrodes.

* * * * *